United States Patent [19]

Hanano et al.

[11] Patent Number: 4,598,811

[45] Date of Patent: Jul. 8, 1986

[54] BALUSTRADE FOR A PASSENGER CONVEYOR

[75] Inventors: Masamitsu Hanano; Chuichi Saito, both of Katsuta, Japan

[73] Assignee: Hitachi, Ltd., Tokyo, Japan

[21] Appl. No.: 762,330

[22] Filed: Aug. 5, 1985

Related U.S. Application Data

[63] Continuation of Ser. No. 406,787, Aug. 10, 1982, abandoned.

[30] Foreign Application Priority Data

Aug. 28, 1981 [JP] Japan ..... 56-134179

[51] Int. Cl.[4] ..... B66B 9/14

[52] U.S. Cl. ..... 198/335; 52/787; 52/825

[58] Field of Search ..... 198/335; 411/546; 256/24, 59, 68, 69; 403/408; 52/309.2, 787, 788, 790; 16/220; 52/825

[56] References Cited

U.S. PATENT DOCUMENTS

| | | | |
|---|---|---|---|
| 3,321,059 | 5/1967 | Kroepel | 198/335 |
| 3,989,133 | 11/1976 | Courson et al. | 198/335 |
| 3,991,877 | 11/1976 | Kraft et al. | 198/335 |

FOREIGN PATENT DOCUMENTS

| | | | |
|---|---|---|---|
| 1512084 | 2/1968 | France | 198/335 |
| 55987 | 5/1979 | Japan | 198/335 |
| 2104471 | 3/1983 | United Kingdom | 198/335 |

*Primary Examiner*—Joseph E. Valenza
*Assistant Examiner*—Stuart J. Millman
*Attorney, Agent, or Firm*—Antonelli, Terry & Wands

[57] ABSTRACT

This invention describes a balustrade for passenger conveyors, comprising a handrail adapted to be moved synchronously with endless moving stairway, panels consisting of transparent glass plates and, immediately under the handrail, an upper unit provided between upper ends of the transparent panels and a lower surface of the handrail and adapted so as to guide the handrail, and a lower unit provided at the lower ends of the transparent panels and consisting of inner and outer decks, the handrail-guiding upper unit consisting of a guide frame adapted to guide the handrail and having a groove for fitting upper the end portions of the tranparent panels thereinto, a fastener for press-tightening the transparent panels in the groove, a limiter for restricting the tightening force of the fastener and guides fitted around an outer circumferential surface of the guide frame, the upper unit as a whole being positioned within the handrail.

3 Claims, 7 Drawing Figures

BALUSTRADE FOR A PASSENGER CONVEYOR

This is a continuation of application Ser. No. 406,787 filed Aug. 10, 1982 and now abandoned.

BACKGROUND OF THE INVENTION

Field of the Invention

This invention relates to a balustrade for passenger conveyors, such as, for example, escalators, and so-called moving sidewalks.

A balustrade for passenger conveyors generally includes a handrail adapted to be moved synchronously with an endlessly moving stairway or conveyor belt, with the balustrade including, panels composed of transparent glass plates provided immediately under the handrail, an upper unit provided between upper ends of the transparent panels and a lower surface of the handrail adapted to guide the handrail, and a lower unit provided at a lower end of the transparent panels and composed of inner and outer decks.

The relative dimensions between the principal elements in known balustrades is that the width of the handrail frame constituting the upper unit is about 2–3 times that of the handrail, and projects inward and outward beyond the side ends of the handrail by about 10–50 mm.

Demand has recently increased for a conventional balustrade for passenger conveyors, of the type described above but which has been modified to a non-illuminated, more energy-saving design.

However, when a passenger conveyor having a conventional balustrade is operated without internal illumination in the balustrade, the room illumination, e.g. ceiling lights, is inadequate because the moving steps or conveyor belt are in the shadow of the balustrade.

A disadvantage of the previously proposed conventional balustrades resides in the fact that when a small child places his hand on the handrail, the child's wrist could contact the inward projecting part of the handrail frame causing injury. Also, it is likely that a child's foot could slip into a gap between the skirt guard and the steps when the foot comes in contact with the skirt guard of the conveyor.

A further disadvantage of this kind of balustrade is that fine powder abraded from the handrail accumulates on the upper handrail surface. This feels unpleasant and is likely to soil the passenger's clothes and hands.

A balustrade for passenger conveyors, in which these safety and designing problems are solved by employing a handrail frame having no parts that project inward or outward beyond the side ends of the handrail, and by providing transparent panels immediately under the handrail, has been proposed. However, in this proposed balustrade, the step-lighting problem cannot be solved due to the opaque handrail frame between the handrail and the transparent panels.

Moreover, the opaque handrail frame between the handrail and the transparent panels detracts from the simplicity of the balustrade design.

SUMMARY OF THE INVENTION

An object of the present invention is to provide a balustrade for passenger conveyors, which is safe, well lighted and has good design characteristics.

This object can be attained in an configuration in which the handrail-guiding upper unit includes a guide frame adapted to guide a handrail and having a groove for fitting the upper end portions of transparent panels thereinto, a bolt for press-tightening the transparent panels in the groove, a limiter for restricting the tightening force of the bolt, and guides covering the guide frame, with the upper unit as a whole being positioned within the handrail.

DETAILED DESCRIPTION

Figure 1:
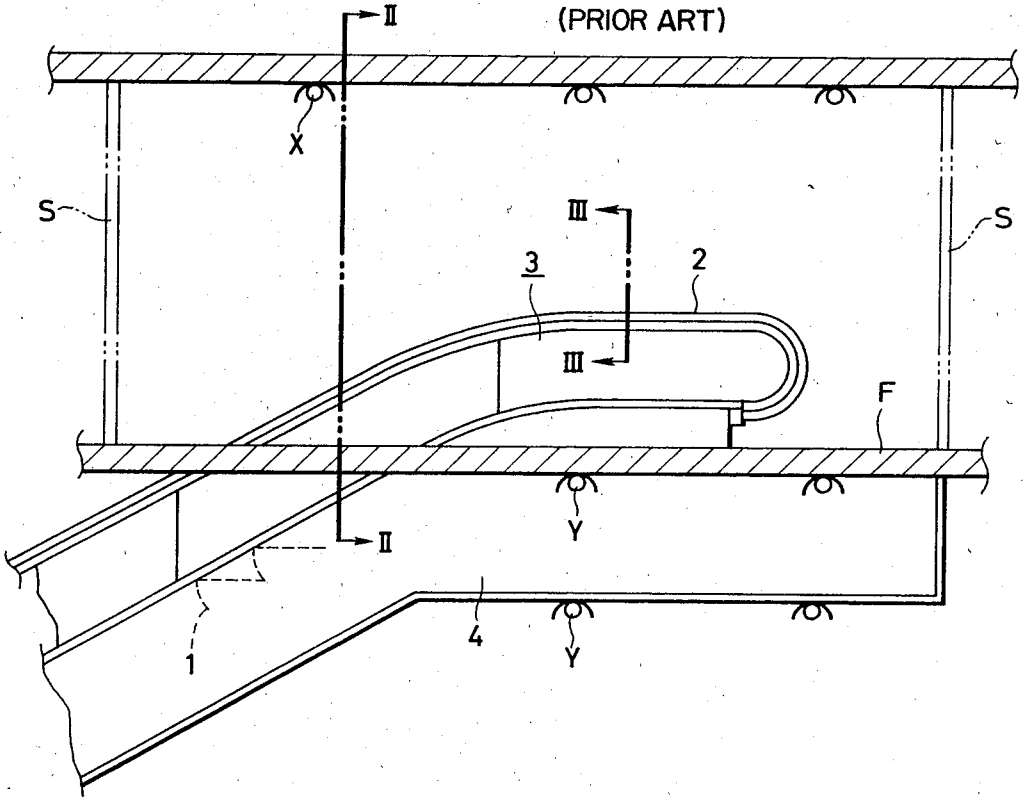
FIG. 1 (PRIOR ART)
FIG. 1 is a side elevational view of an upper portion of a prior art conveyor, to which the present invention is applied.

A conventional pedestrian conveyor, the construction of which is shown in FIG. 1, includes a moving body composed of an endless moving stairway 1, handrails 2, a stationary body including balustrades 3, and main frames 4, with all of these parts being supported on a floor F of a building.

Figure 2:
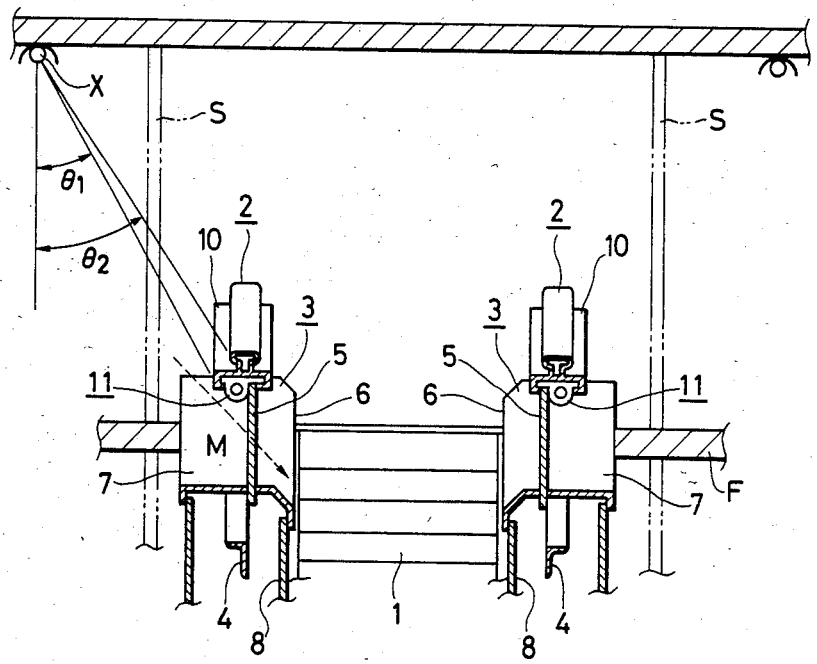
FIG. 2 (PRIOR ART)
FIG. 2 is a sectional view taken along the line II—II in FIG. 1.
Figure 3:
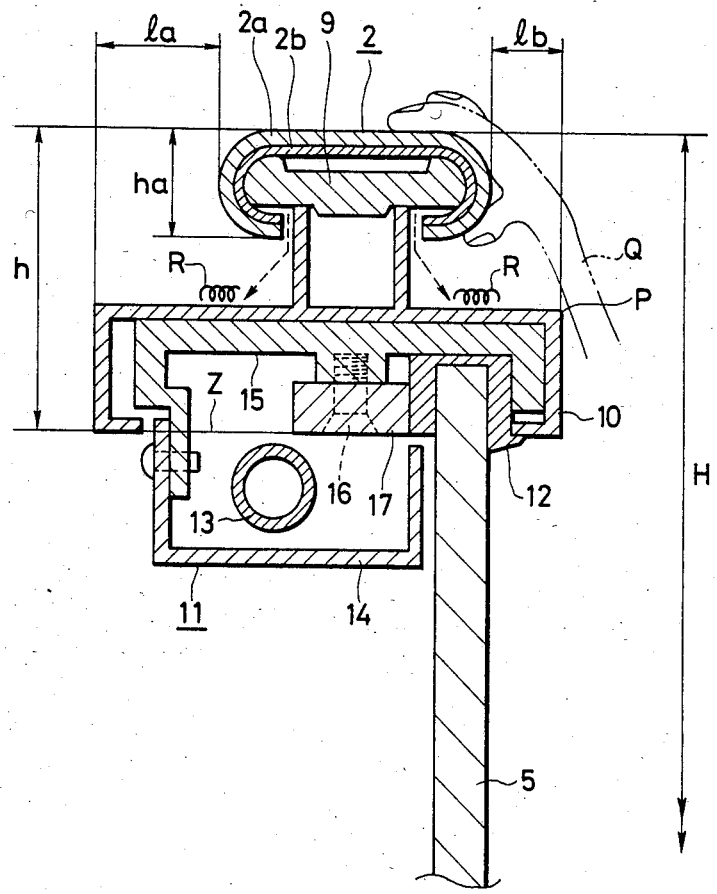
FIG. 3 (PRIOR ART)
FIG. 3 is a sectional view taken along the line III—III in FIG. 1.

As shown most clearly in FIGS. 1–3, the balustrade 3, includes a lower unit including glass panels 5 supported on the main frame 4, an inner deck 6, an outer deck 7, and a skirt guard 8, and an upper unit provided on the upper side of the glass panels 5 and consisting of a guide 9 for the handrail 2, a handrail frame 10, and an illuminator 11. On the inner side of the handrail frame 10, generally fashioned of stainless steel, additional parts are provided, which are a packing 12 for protecting the glass panels 5, a support body 15 clamping the glass panels 5 and supporting a lamp 13 and a cover 14, which constitute the illuminator 11, and a press plate 17 fastened to the support body 15 with bolts 16 to finally fix the panels 5.

The guide 9 in the upper unit has dimensions that permit the guide 9 to be engaged with the inner circumferential surface of the handrail 2, which consists of a decorative rubber portion 2*a* and a cotton canvas portion 2*b*. The guide 9 is fastened to the handrail frame 10 with bolts (not shown). The handrail frame 10 has a height h, which is 2–3 times as great as the height ha of the handrail 2. The handrail frame 10 generally projects in the lateral direction beyond side ends of the handrail 2 by a distance la in the outward direction and by a distance lb in the inward direction (generally, both la and lb are 10–50 mm). That portion of the handrail frame 10 which projects beyond the handrail 2 by la is utilized to house the illuminator 11, and that portion of the handrail frame 10 which projects beyond the handrail 2 by lb to clamp the glass panels 5.

When the illuminator 11 shown in FIG. 3 is removed, a closure member represented by an imaginary line Z is provided to cover the handrail frame 10. Thus, the parts (including the handrail frame 10) constituting the balustrade body are not usually modified. In a pedestrian conveyor, without illuminator 11, the intensity of illumination of ceiling illuminators X, Y is increased to light the moving stairway adequately for passenger safety. However, in a balustrade provided with a handrail frame 10 having the same dimensions and construction as a conventional handrail frame, it is very inconvenient to light the moving stairway.

This is because the rays of light from the ceiling illuminator X reach the steps 1 along an arrow M through the glass panels 5, and an angle $\theta_1$ of incidence of the rays of light is restricted by a distance la, at which the handrail frame 10 projects beyond the handrail 2, and a height h of the handrail frame 10. The stairway illuminating problem in this pedestrian conveyor is serious, especially, when the pedestrian conveyor is surrounded by screens S. Illumination in this case would be inadequate for passenger safety.

With regard to the safety of the pedestrian conveyor, it is evident that a small child cannot safely grasp the handrail 2. The balustrade reaches a height H of 650–750 mm above the upper surface of a step 1 as shown in FIG. 3, so as to prevent passengers from falling. That is to say, the balustrade is suitable for school children and adults. However, the height H is too high for preschool children, and is inconvenient to such children in other respects. As shown in FIG. 3, a part of a hand Q of a preschool child contacts a corner (point P) of the handrail frame 10 in a way that prevents a secure grasping of the handrail 2.

When a preschool child tries to grasp the handrail 2 in this manner, the foot of the child is likely to be placed so near the skirt guard 8 as to be drawn into the space around the step 1.

The abraded powder R from the handrail 2 accumulates on the upper surface of the handrail frame 10. The abraded powder R consists of a mixture of iron and rubber materials used in the handrail driving system, and the cotton canvas portion 2*b*. The unsanitary condition of such a public facility, which soils the clothes of the passengers is unacceptable.

Figure 4:
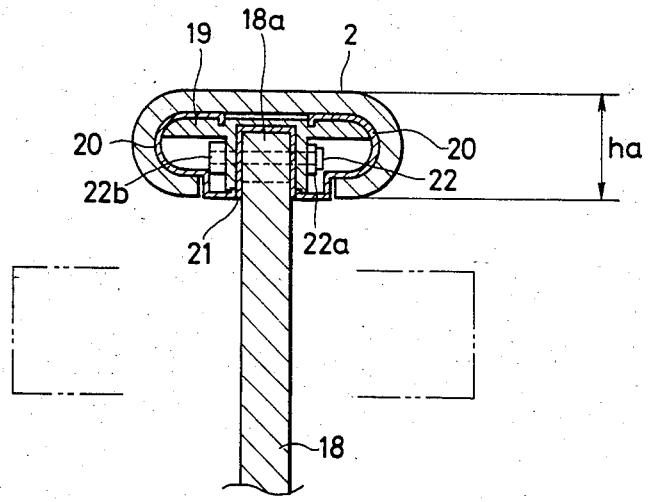
FIG. 4 is a sectional view coresponding to FIG. 3 and illustrating an embodiment of a balustrade for passenger conveyors according to the present invention.
Figure 5:
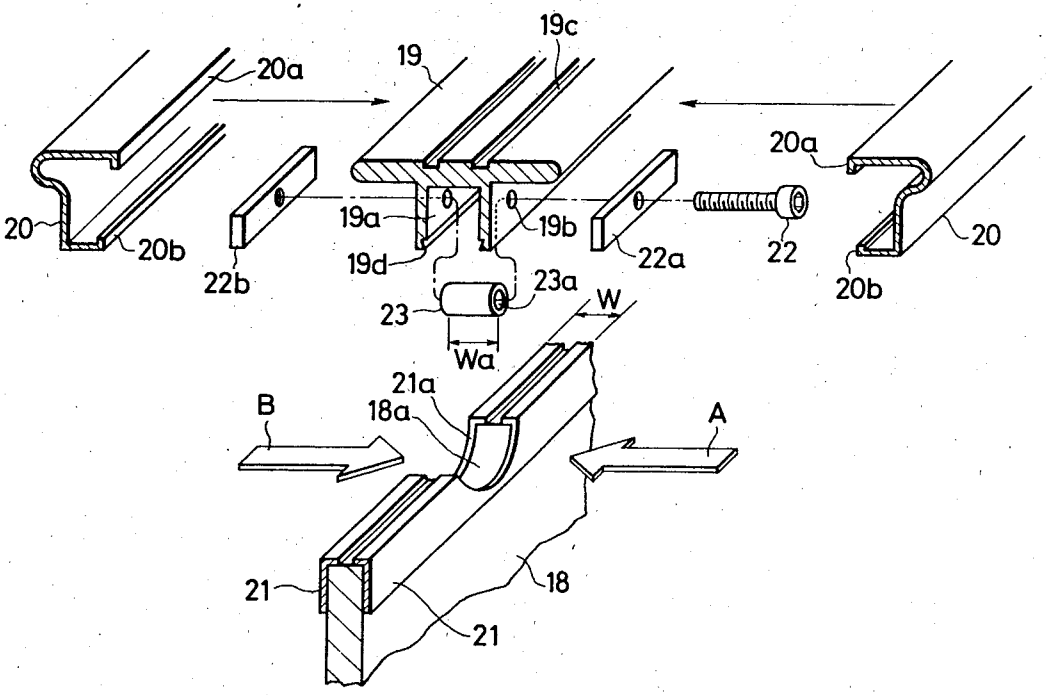
FIG. 5 illustrates the details of an upper unit of the balustrade shown in FIG. 4.

As shown in FIGS. 4 and 5, a driving mechanism of the conveyor including stairs 1, a main frame 4, and a lower unit consisting of an inner deck 6, an outer deck 7 and a skirt guard 8 is the same as that in a conventional balustrade of this kind. The present invention is characterized in that an upper unit consists of a guide frame 19 having a groove 19*a* for fitting upper end portions of glass panels 18, corresponding to the glass panels 5, therein, fastening parts, such as bolts 22, and guides 20 fitted around an outer circumferential surface of the guide frame 19.

The guide frame 19 is formed continuously with respect to the whole length of the balustrade, and has a groove 19*a* for accommodating the upper end portions of the glass panels 18 having a width W, which includes the thickness of a packing 21 protecting the upper end portions of the glass panels 18. The glass panels 18 are provided with a plurality of recesses 18*a* in upper and surfaces thereof with respect to the whole length of the conveyor. Also, the portions of the packing 21 which correspond to the recesses 18*a* are provided with openings 21*a*. The following parts are attached to those portions of the guide frame 19 which are provided with through holes 19*b*. First, a limiter 23 having a bore 23*a*, aligned with the through holes 19*b*, is inserted in the groove 19*a*. Then, a bolt 22 is threadly inserted into a threaded hole in a washer member 22*b* through the other washer member 22*a*, through holes 19*b* and limiter 23. Consequently, the limiter 23 is inserted in the recess 18*a*.

The width Wa of the limiter 23 is slightly smaller than the width W (Wa < W) of the glass panel 18. The bolt 22 is tightened until the inner surfaces, which define the groove 19*a*, of the guide frame come into contact with the limiter 23 or until the groove 19*a* has been deformed to cause the width thereof to agree with that (Wa) of the limiter 23. This amount of deformation of the groove 19*a*, i.e. the difference between the widths W, Wa, is in agreement with a tightening margin of the bolt 22 with respect to the glass panels 18 and packing 21, which are tightened in the directions of arrows A, B. The limiter 23 substantially serves as a stopper for preventing any excessive tightening force from being applied to the glass panels 18. Thus, the guide frame 19 is not excessively deformed and the glass panels 18 are not damaged. The washer members 22*a*, 22*b* are provided so as to apply the tightening force of the bolt 22 widely to the glass panels 18, and have a tightening surface wider than that of a head of an ordinary bolt or that of a nut.

The upper unit of the balustrade is covered from both sides thereof with guides 20, with each of the guides 20 having an upper projection 20*a* engaged with a groove 19*c* formed in the upper surface of the guide frame 19, and a lower projection 20*b* engaged with a groove 19*d* formed in the lower end of the panel fitting groove 19*a* in the guideframe 19, so that the guides 20 do not come off from the guide frame 19. Each of the guides 20 is so formed that an upper portion of the guide 20 engages the inner circumferential surface of the handrail 2 to guide the handrail, with a lower portion thereof closing an opened portion of the handrail 2 and a lower end portion of the guide frame 19. The guides 20 have a low coefficient of friction, and consist of a plastic material such as nylon, which is suitable for the handrail 2 moving thereon. The guides 20 extend continuously with respect to the whole length of the conveyor.

Each of the parts referred to above of the upper unit of the balustrade has suitable width and height, so that all of the parts can be housed efficiently in a space in the handrail 2.

Since the upper unit including the guide frame 19, guides 20, etc. is disposed within the space defined by the inner circumferential surface of the handrail 2, the balustrade according to the invention is free from the problems encountered in a conventional balustrade, in which the handrail frame 10 extends downward and projects laterally by distances la, lb beyond the handrail 2.

Accordingly, the angle of incidence ($\theta_2$ according to the present invention, which is greater than $\theta_1$) shown in FIG. 2 is increased. Therefore, such an energy-saving balustrade (not requiring illuminators 11) also permits the stairs of the conveyor to be illuminated adequately and the pedestrians to ride the conveyor safely.

The balustrade according to the present invention does not have portions similar to the portions of a conventional balustrade, which project beyond the handrail by distances la, lb, and which pose safety and designing problems in the latter balustrade. It can be said that the success in eliminating these projecting portions contributes much to the novel effect of the present invention.

Figure 6:
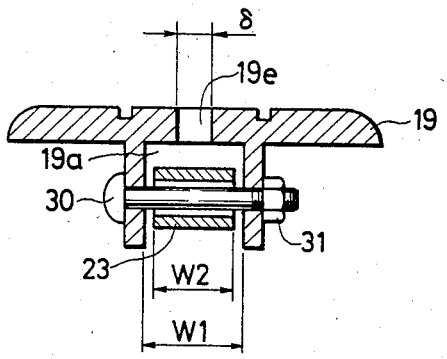
FIG. 6 is a sectional view illustrating another embodiment formed by modifying the first-mentioned embodiment.
Figure 7:
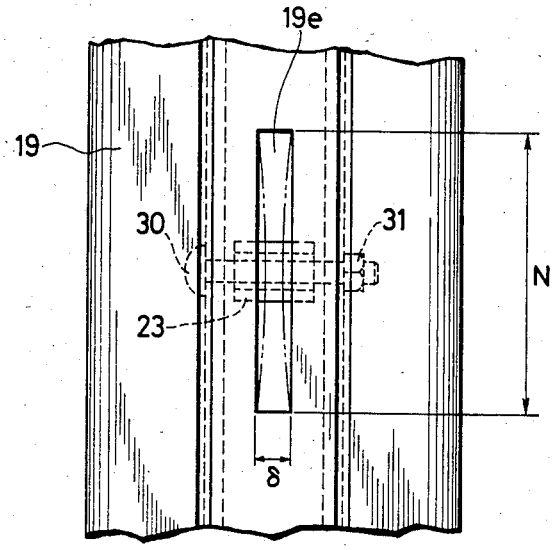
FIG. 7 is a plan view of the embodiment shown in FIG. 6.

As shown in FIGS. 6 and 7, setting screw 30 is so disposed in a recess 18*a* (FIG. 5) in a glass panel 18 provided suitably so as to extend in the direction of length of the conveyor that an elongated panel fitting groove 19*a* is sandwiched between a head of the screw 30 and a nut 31. The screw 30 is thus passed through the panel fitting groove 19*a* (having a width $W_1$), and a limiter 23 having a width $W_2$ ($W_1 > W_2$) is also provided in the elongated groove 19*a*. A clamping application slot 19*e* having a width $\delta$ and a length N is provided in the central part in the widthwise direction of the upper surface.

The arrangement is such that as the screw 30 is tightened, the guide frame 19 is deformed as shown by the two-dot chain line of FIG. 7, and the glass panel 18 and the packing 21 are clamped correspondingly to the deformation. The elongated slot 19*e* is provided to facilitate the deformation of an upper portion of the guide frame 19 and prevent any waste of a clamping force applied by the screw 30, and thereby permit the tightening force of the screw 30 to be effectively used for clamping the glass panel 18. This allows the stable tightening force to be transmitted to the glass panel 18.

Thus, the present invention provides a safe, well-lighted, smooth-running a conveyor having good design characteristics.

We claim:

1. A balustrade for a passenger conveyor, comprising a handrail of a C-shaped cross-section adapted to be moved synchronously with endless moving stairs, panels comprising transparent glass plates and provided immediately under said handrail, a handrail guiding upper unit provided between upper ends of said transparent panels and a lower surface of said handrail and adapted to guide said handrail, and a lower unit provided at lower ends of said transparent panels and including inner and outer decks, said handrail-guiding upper unit comprising a guide frame having a horizontal portion and vertical portions extending downwardly therefrom and oppositing each other at a distance from each other, said vertical portions and horizontal portion forming a panel fitting groove for receiving an upper end of said transparent panel and being adapted to guide the movement of said handrail; clamping means for clamping said fitted panel in said panel fitting groove of said guide frame; a limiting member for for limiting the clamping force of said clamping means applied to said panel; and a guide adapted to cover an outer peripheral surface of said guide frame and slide along an inner periphery of said handrail, said handrail-guiding upper unit is located within the inside of said handrail of said C-shaped cross section and within a range of a height of said handrail, a space between an opening of the handrail and said guide frame is closed by said guide, and wherein each of said transparent panels is provided in a upper end portion thereof with recess for inserting said clamping means therethrough.

2. A balustrade for a passenger conveyor according to claim 1, wherein said guide adapted to cover the outer peripheral surface of said guide frame includes right and left, symmetrical, cross-sectionally C-shaped guides, each of said guides including an upper projection and a lower projection, the upper projection of said C-shaped guides being fitted in grooves provided in an upper surface of the horizontal portion of said guide frame, and wherein the lower projections of the respective C-shaped guides are fitted in grooves provided in a lower end of the respective vertical portions of said guide frame.

3. A balustrade for a passenger conveyor according to claim 1, wherein a portion of an upper wall of said guide frame which is above said clamping means is provided with an elongated bore extending in the direction of length of said guide frame.

* * * * *